US006960012B1

(12) United States Patent
Biber

(10) Patent No.: US 6,960,012 B1
(45) Date of Patent: Nov. 1, 2005

(54) METHOD OF MIXING FLUID IN F-STYLE CONTAINER

(75) Inventor: Joseph N. Biber, Macedonia, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 219 days.

(21) Appl. No.: 10/645,195

(22) Filed: Aug. 21, 2003

Related U.S. Application Data

(60) Provisional application No. 60/405,095, filed on Aug. 21, 2002.

(51) Int. Cl.[7] ..... B01F 11/00
(52) U.S. Cl. ..... 366/110; 366/605
(58) Field of Search ..... 366/110–112, 208–212, 366/348, 605

(56) References Cited

U.S. PATENT DOCUMENTS

| | | | | |
|---|---|---|---|---|
| D210,003 | S | 1/1968 | Macaulay et al. | D9/53 |
| D223,896 | S | 6/1972 | Frazer | D9/42 |
| D228,230 | S | 8/1973 | Cutler | D9/52 |
| D229,483 | S | 12/1973 | Cutler | D9/175 |
| D230,708 | S | 3/1974 | Hutter et al. | D9/40 |
| D237,255 | S | 10/1975 | Plummer | D9/52 |
| 4,134,689 | A | 1/1979 | Ahrenskou-Sorensen | 366/110 |
| D274,130 | S | 6/1984 | Collins, II | D9/376 |
| D282,637 | S | 2/1986 | Beaver et al. | D9/376 |
| D302,523 | S | 8/1989 | Suhajda | D9/376 |
| 5,268,620 | A | 12/1993 | Hellenberg | 318/114 |
| 5,590,786 | A | 1/1997 | Jaycox | 206/587 |
| 5,906,433 | A * | 5/1999 | Mazzalveri | 366/209 |
| 6,767,127 | B2 * | 7/2004 | Paganelli | 374/55 |
| 2004/0008573 | A1 * | 1/2004 | MacDonald et al. | 366/209 |
| 2004/0013031 | A1 * | 1/2004 | Salas et al. | 366/141 |

FOREIGN PATENT DOCUMENTS

| | | | |
|---|---|---|---|
| GB | 1 310 655 | * | 3/1973 |

* cited by examiner

*Primary Examiner*—David L. Sorkin
(74) *Attorney, Agent, or Firm*—Robert E. McDonald; Paul R. Katterle; Vivien Y. Tsang

(57) ABSTRACT

A method and apparatus of for mixing a tinting concentrate disposed in a container. The container is held inside a larger bucket by a base insert and a top insert. The bucket with the container secured therein is clamped to a table of a mixing apparatus. The table is then vibrated, thereby mixing the tinting concentrate.

7 Claims, 11 Drawing Sheets

METHOD OF MIXING FLUID IN F-STYLE CONTAINER

CROSS-REFERENCE TO RELATED APPLICATION

This application claims the benefit of U.S. provisional patent application No. 60/405,095 filed on Aug. 21, 2002, the entirety of which is hereby incorporated by reference.

BACKGROUND OF THE INVENTION

The present invention relates to the mixing of fluid dispersions and more specifically to apparatus and methods for mixing a tinting concentrate disposed in a container.

In retail paint stores, architectural paints are typically prepared by adding one or more tinting concentrates to a white or pastel base to obtain a particular color desired by a customer. A tinting concentrate comprises highly concentrated levels of color pigment ground or dispersed into a grinding vehicle, such as a blend of water, surfactants, dispersants and other additives. One representative tinting concentrate blend could comprise one or more pigments, water, surfactants, dispersants and ethylene glycol. Tinting concentrates are typically provided in plastic containers commonly referred to as F-style containers. An F-style container generally has a rectangular body with a top mounted handle and an offset pour spout. Examples of F-style containers are shown in U.S. Pat. Nos. Des. 228,230; Des. 237,255; and Des. 274,130, all of which are hereby incorporated by reference.

Since a tinting concentrate is a dispersion of solid pigment in a liquid vehicle, the pigment tends to settle toward the bottom of the F-style container through the force of gravity. If such settling is allowed to occur, the concentration of pigment in the tinting concentrate will vary from location to location within the F-style container. Such variations in the pigment concentration can cause inaccuracies in tinting and can adversely impact the dispersion of the pigment in the paint.

In order to prevent the pigment from settling in a tinting concentrate, the tinting concentrate is mixed by manually shaking the F-style container. Such manual shaking, however, is physically demanding and often results in less than satisfactory mixing of the tinting concentrate. Accordingly, it would be desirable to mix the tinting concentrate using a mixing machine.

Mixing machines exist for mixing paint in containers. Conventional paint mixing machines, however, are specially designed to handle metal cylindrical one gallon paint cans and/or five gallon cylindrical plastic buckets. Conventional mixing machines typically cannot accommodate F-style containers or will damage F-style containers.

Accordingly, there is a need in the art for an apparatus and method for mechanically mixing tinting concentrates. The present invention is directed to such an apparatus and method.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
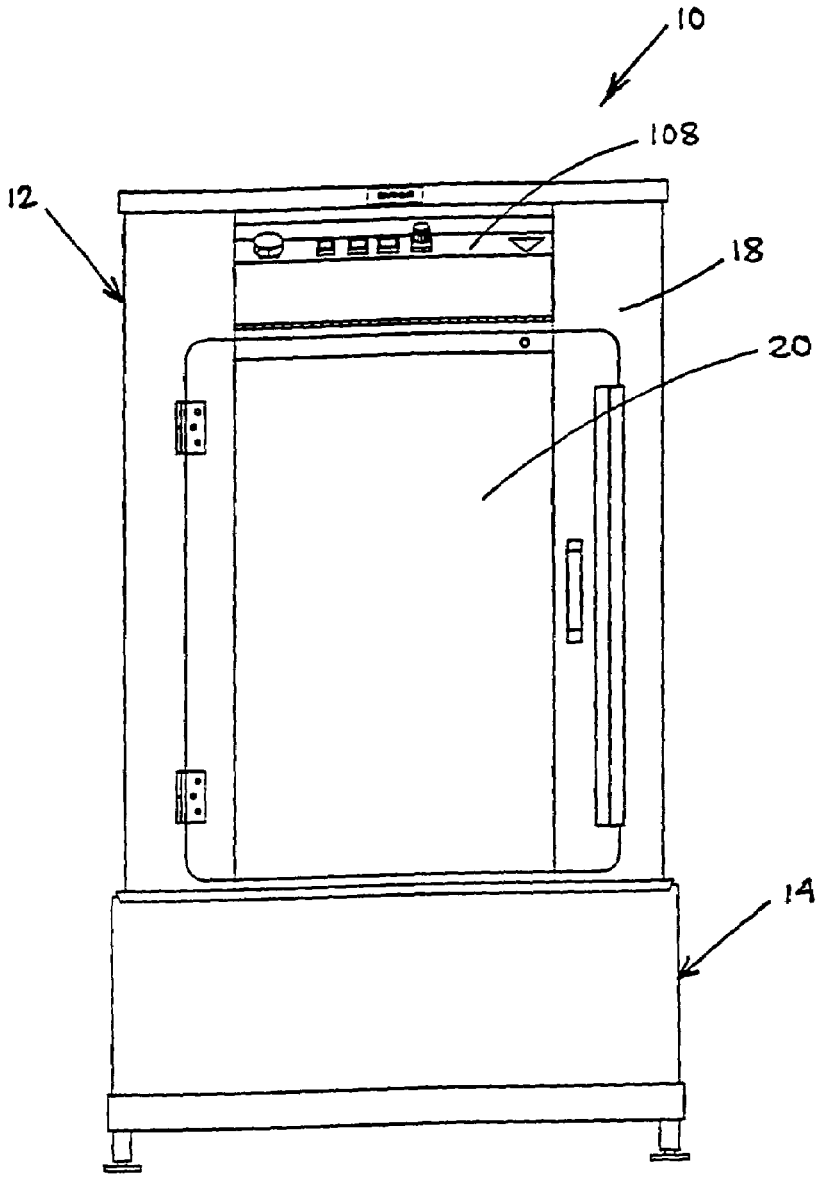
FIG. 1 shows a front view of a mixing apparatus.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, "tinting concentrate" shall mean a fluid pigment concentrate comprising highly concentrated levels of color pigment ground into a grinding vehicle. The most common grinding vehicle used in tinting concentrates is a blend of ethylene glycol and water in conjunction with various surfactants. Color pigments typically used include ferrite yellow oxide, red iron oxides, ferric iron oxide brown (which is a blend of red, yellow, and black iron oxides), tan oxide (which is a similar blend), raw sienna and burnt sienna, raw and burnt umber, copper phthalo cyanine green and blue, DNA orange (dinitroaniline orange #5), carbon black, lampblack, toluidine red, parachlor red, (burnt red and maroon red) hansa yellows which are azo coupling of metapara nitrotoluidiene and quinacridone red, magenta and violet. The amount of color pigment used in a tinting concentrate is typically from about 5 weight percent to about 70 weight percent, depending on the type of color pigment.

As used herein, the term "conventional five gallon paint bucket" shall mean a cylindrical plastic bucket for holding paint, having an interior volume of slightly greater than 5 gallons. A conventional five gallon paint bucket typically has a lower interior diameter of about 10⅛ inches, a larger upper interior diameter of about 11⅛ inches and a height of about 14¾ inches.

As used herein, the term "F-style container" shall mean a container for holding liquids, wherein the container has a generally rectangular footprint, an upwardly-opening threaded collar for closure with a threaded cap, and a top-mounted handle.

Referring now to FIG. 1, there is shown a mixing apparatus 10 that may be used in the present invention. The mixing apparatus 10 is adapted to mix a fluid dispersion, such as paint, that is disposed in a conventional five gallon paint bucket.

Figure 2:
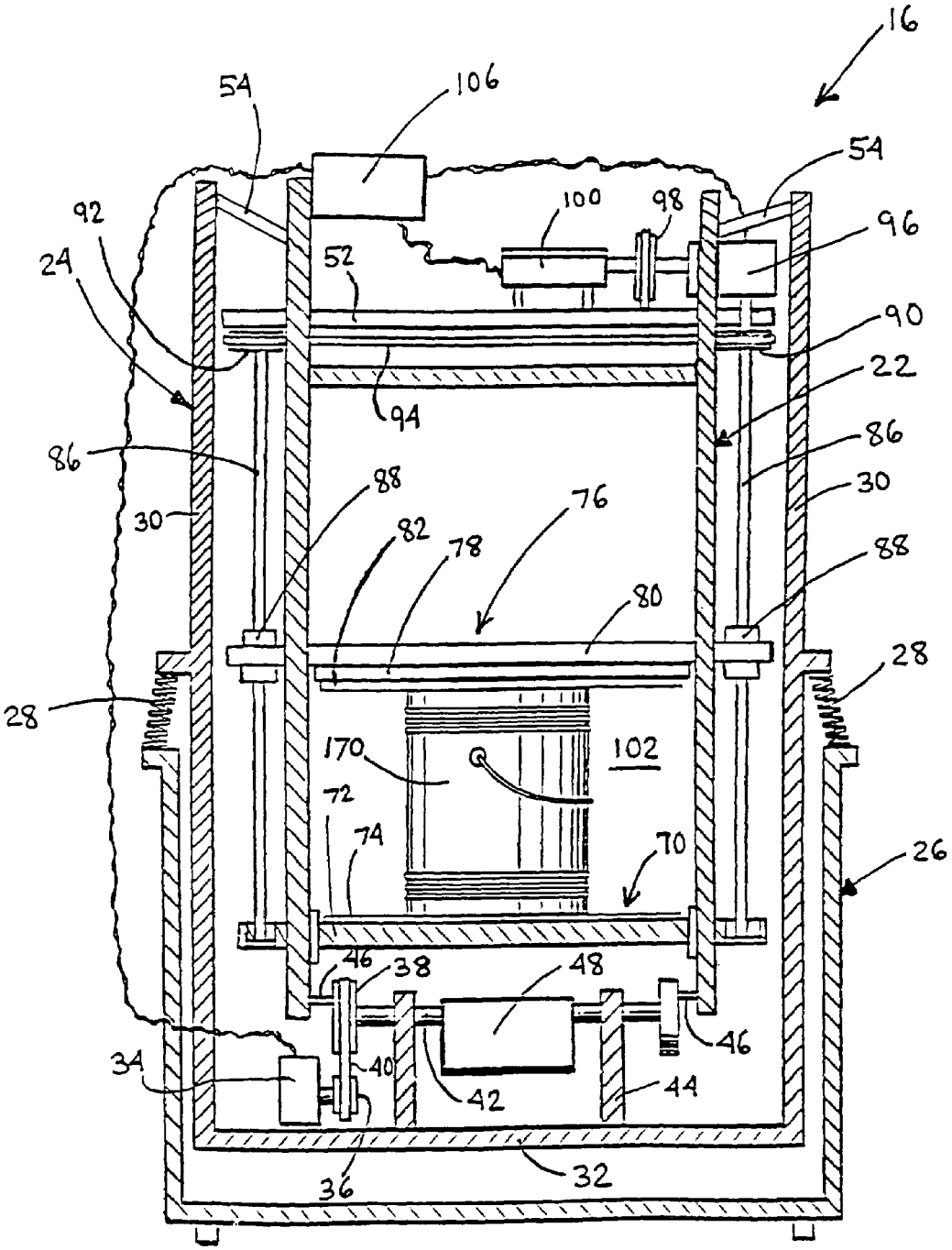
FIG. 2 shows a schematic cross-sectional view of a frame assembly of the mixing apparatus.
Figure 3:
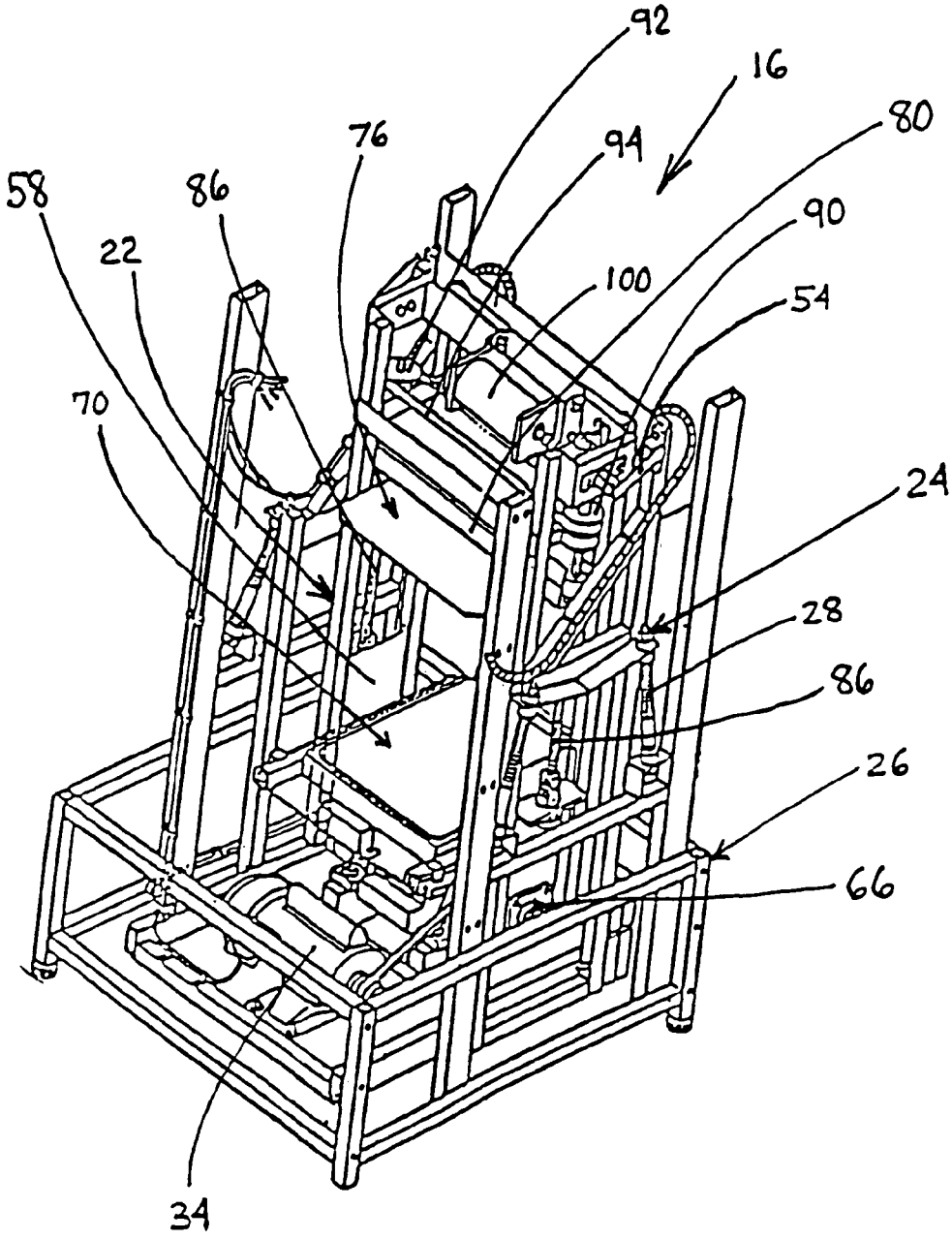
FIG. 3 shows a perspective view of the frame assembly.
Figure 4:
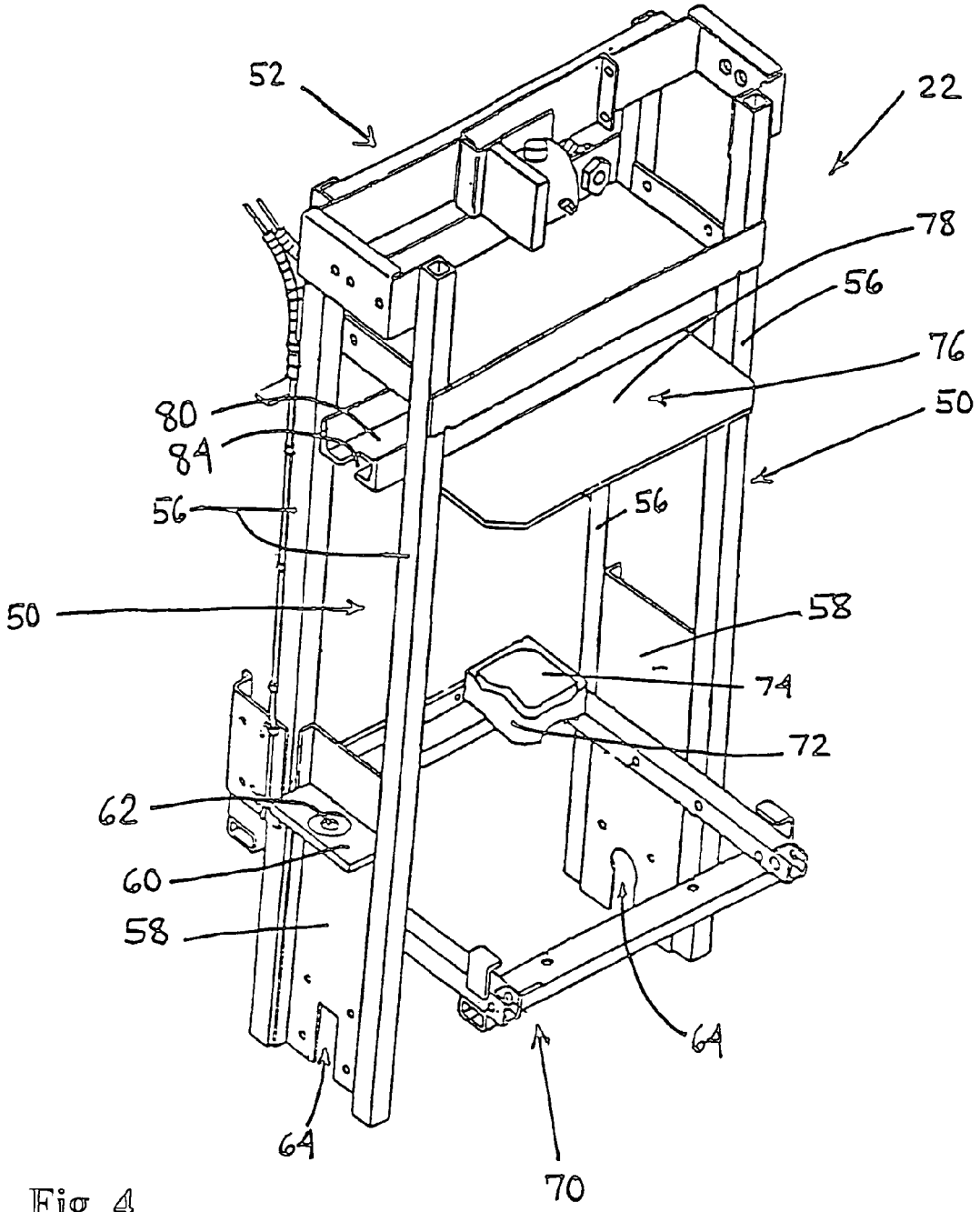
FIG. 4 shows a perspective view of an inner frame of the frame assembly.

The mixing apparatus 10 has an upper housing 12 and a lower housing 14 that enclose a frame assembly 16 (shown in FIGS. 2, 3 and 4). The upper housing 12 includes a front wall 18 secured to side walls of a wrapper (not shown). The front wall 18 defines an enlarged opening that is closed by a pivotable door 20.

Referring now to FIG. 2, there is shown a schematic cross-sectional view of the frame assembly 16, which includes inner, middle, and outer frames 22, 24, 26. The middle frame 24 is suspended by springs 28 in the outer frame 26. The middle frame 24 includes a pair of opposing side structures 30 secured to a bottom structure 32. An electric shaking motor 34 is mounted to the bottom structure 32 and is operable to rotate a drive pulley 36 that is drivingly connected to a larger diameter crankshaft pulley 38 by an endless belt 40. The crankshaft pulley 38 is secured to a crankshaft 42 that is rotatably mounted to a bearing mount 44 secured to the bottom structure 32. The crankshaft 42 has opposing ends with eccentric pins 46 extending therefrom. The eccentric pins 46 are connected to the inner frame 22, as described below. An eccentric counterweight 48 is secured to a middle portion of the crankshaft 42 and is offset 180° from the pins 46. The counterweight 48 balances the forces generated by the movement of the inner frame 22 and any container disposed therein. When the shaking motor 34 is energized, the inner frame 22 is subjected to a vibration, the path of which can be considered pear shaped.

Referring now also to FIGS. 3 and 4, the inner frame 22 includes a pair of opposing side structures 50 secured to a top structure 52. Opposing ends of the top structure 52 are respectively connected to the side structures 30 of the middle frame 24 by pivotable links 54. Each of the side structures 50 includes a pair of vertically-extending posts 56 with bottom portions having a bearing plate 58 secured therebetween. Rod mounting plates 60 are joined perpendicularly to outer surfaces of the bearing plates 58 and extend outwardly therefrom in cantilever fashion. Each of the mounting plates 60 has a vertically extending opening 62 formed therein. The bearing plates 58 include downwardly-opening slots 64 over which bearing assemblies 66 are secured. The eccentric pins 46 of the crankshaft 42 extend through the slots 64 and the bearing assemblies 66, thereby connecting the eccentric pins 46 to the bearing plates 58, respectively.

A table 70 is mounted between the bottom portions of the side structures 50 for slidable movement between a retracted position, wherein a major portion of the table 70 is disposed within the inner frame 22, and an extended position, wherein a major portion of the table 70 is disposed outside and in front of the inner frame 22. The table 70 includes a metal plate 72 having a top surface to which a rubber pad 74 is preferably secured. The rubber pad 74 preferably has a thickness of about a ¼ inch.

Figure 5:
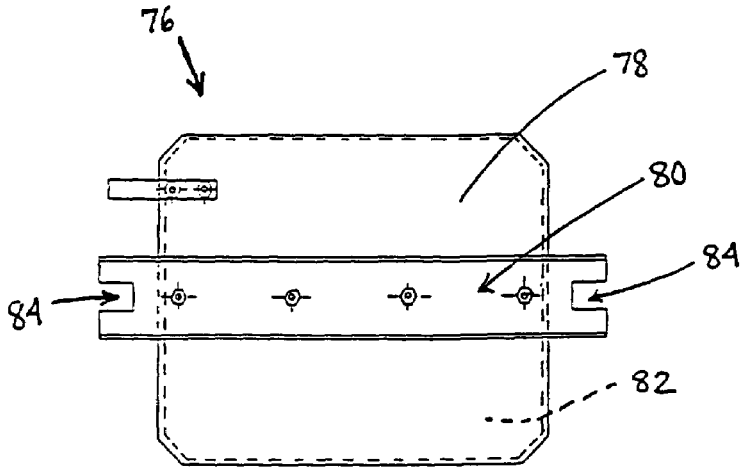
FIG. 5 shows a top view of a clamp assembly of the mixing apparatus.
Figure 7:
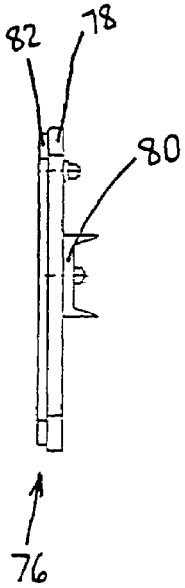
FIG. 7 shows a side view of the clamp assembly.
Figure 6:
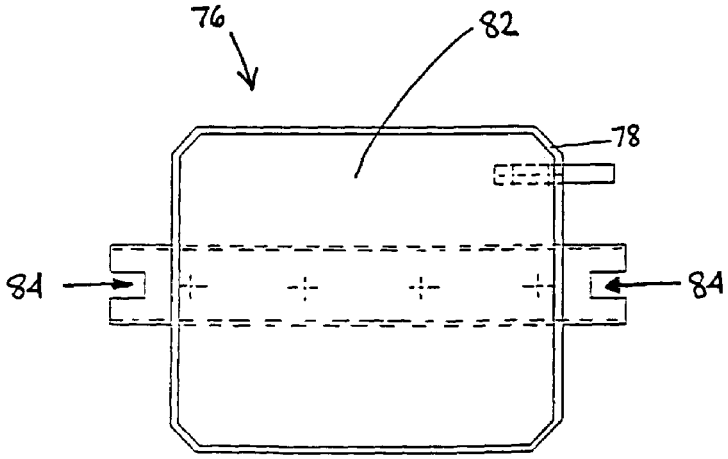
FIG. 6 shows a bottom view of the clamp assembly.

A clamp assembly 76 is disposed between the side structures 50, above the table 70. As best shown in FIG. 5, the clamp assembly 76 includes a generally rectangular clamping plate 78 secured to a channel-shaped upper bar 80. A rubber pad 82 is secured to a bottom surface of the clamping plate 78. The rubber pad 82 preferably has a thickness of about a ¼ inch. Side edges of the clamping plate 78 are disposed inwardly from the posts 56 of the side structure 50. In this manner the clamping plate 78 is fully disposed between the side structures 50 in a lateral direction. In contrast, the upper bar 80 extends between the posts 56 and over the rod mounting plate 60 of each side structure 50. Outwardly-opening notches 84 are formed in the ends of the upper bar 80.

A pair of threaded rods 86 extend through the notches 84 in the ends of the upper bar 80. The rods 86 extend through and are threadably engaged with nuts 88 that are secured to the upper bar 80 around the notches 84. Lower portions of the rods 86 extend through the openings 62 in the rod mounting plates 60 and are secured to the screw mounting plates 60 to permit rotational, but not axial, movement of the rods 86. First and second pulleys 90, 92 are secured to top ends of the rods 86 and are connected together by an endless belt 94. The first pulley 90 is connected by a coupling to a substantially vertical output shaft of a gearbox 96. A horizontal input shaft of the gearbox 96 is connected by a coupling 98 to a drive shaft of a reversible electric clamping motor 100. The gear box 96 and the clamping motor 100 are secured to the top structure 52 of the inner frame 22.

The gear box 96 is operable to translate the rotation of the drive shaft of the clamping motor 100 into rotation of the first pulley 90. The rotation of the first pulley 90, in turn, is transmitted to the second pulley 92 by the endless belt 94. In this manner, the clamping motor 100 is operable to rotate both of the rods 86. Since the clamping motor 100 is reversible, the clamping motor 100 can rotate the rods 86 in two different directions. When the rods 86 are rotating in a first direction, the nuts 88 secured to the upper bar 80 travel up the threads on the rods 86, thereby moving the clamp assembly 76 upward. Conversely, when the rods 86 are rotating in a second direction, the nuts 88 travel down the threads on the rods 86, thereby moving the clamp assembly 76 downward. The clamp assembly 76 is movable between an uppermost position and a lowermost position.

The table 70 and the clamping plate 78 with the rubber pad 74 secured thereto respectively define lower and upper limits of a holding space 102 in which a container, such as a bucket 170, may be disposed for shaking. The height of the holding space 102 is varied by movement of the clamp assembly 76 in response to the rotation of the rods 86. The holding space 102 has a maximum height when the clamp assembly 76 is in the uppermost position and has a minimum height when the clamp assembly 76 is in the lowermost position.

A control system 106 is provided for controlling the operation of the mixing apparatus 10 in response to manual actuation of input devices, such as pushbuttons and timers, located on a control panel 108 (shown in FIG. 1) mounted on the front wall 18 of the upper housing 12. The control system 106 may have the construction and operation of the control system disclosed in U.S. Pat. No. 5,268,620 or the construction and operation of the control system disclosed in U.S. Pat. No. 4,134,689, both of which are hereby incorporated by reference.

Figure 8:
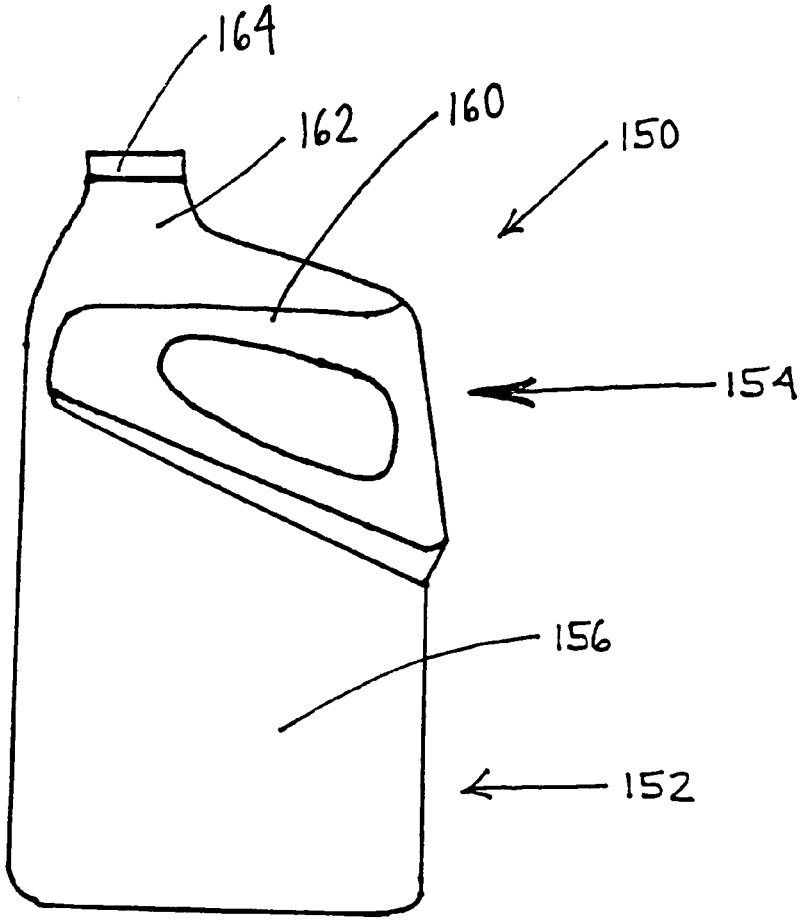
FIG. 8 shows a side view of an F-style container that may be used in the present invention.
Figure 9:
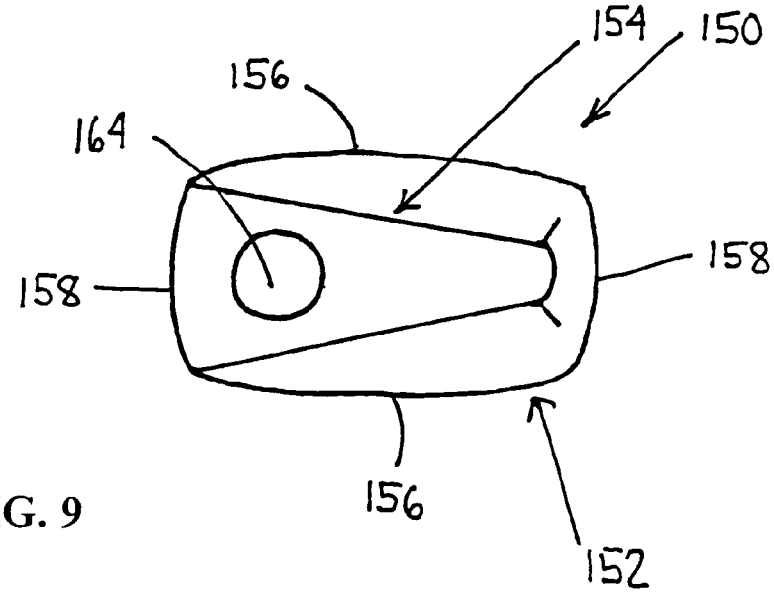
FIG. 9 shows a top view of the F-style container.
Figure 10:
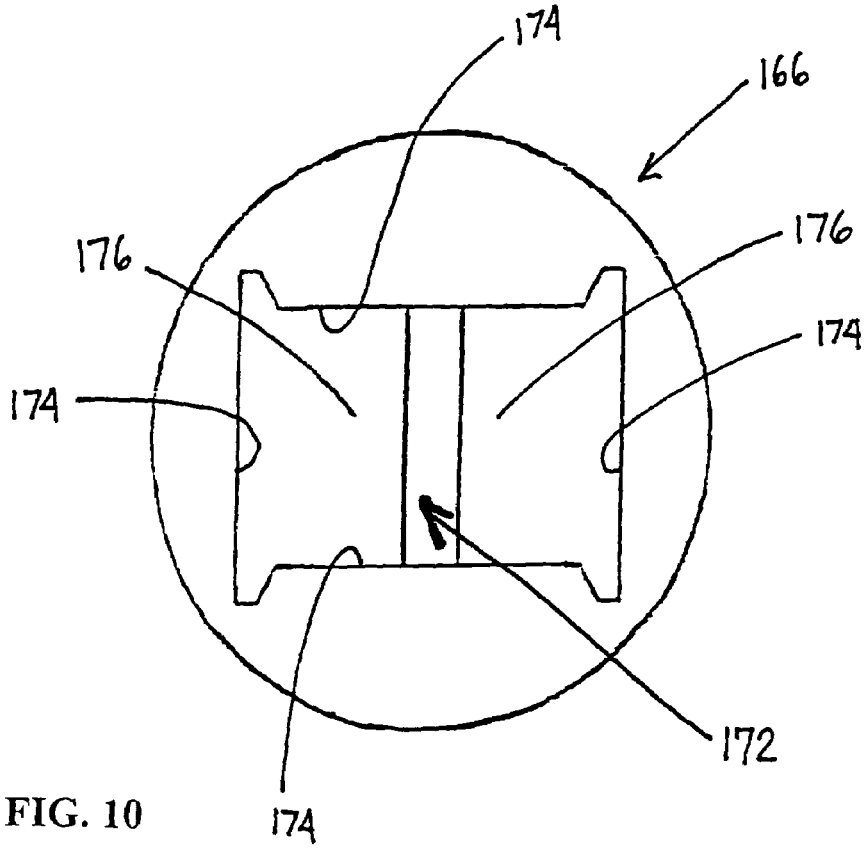
FIG. 10 shows a top view of a base insert of the present invention.

Referring now to FIGS. 8 and 9, there is shown a plastic F-style container 150 that may be used in the present invention. The container 150 is used in the present invention to hold a tinting concentrate. The container 150 has a generally rectangular footprint and includes a lower main portion 152 and an upper handle portion 154. The main portion 152 is generally rectangular and includes a generally rectangular bottom wall (not shown) and a pair of opposing major side walls 156 joined to a pair of opposing minor side walls 158. The handle portion 154 is generally wedge shaped (as viewed from above) and includes a handle 160 joined to a collar 162. The collar 162 is disposed above the handle 160 and defines an opening through which the tinting concentrate in the container 150 may be poured. The collar 162 has an exterior thread (not shown) that mates with the interior thread (not shown) of a cap 164 that closes the opening of the collar 162.

Figure 16:
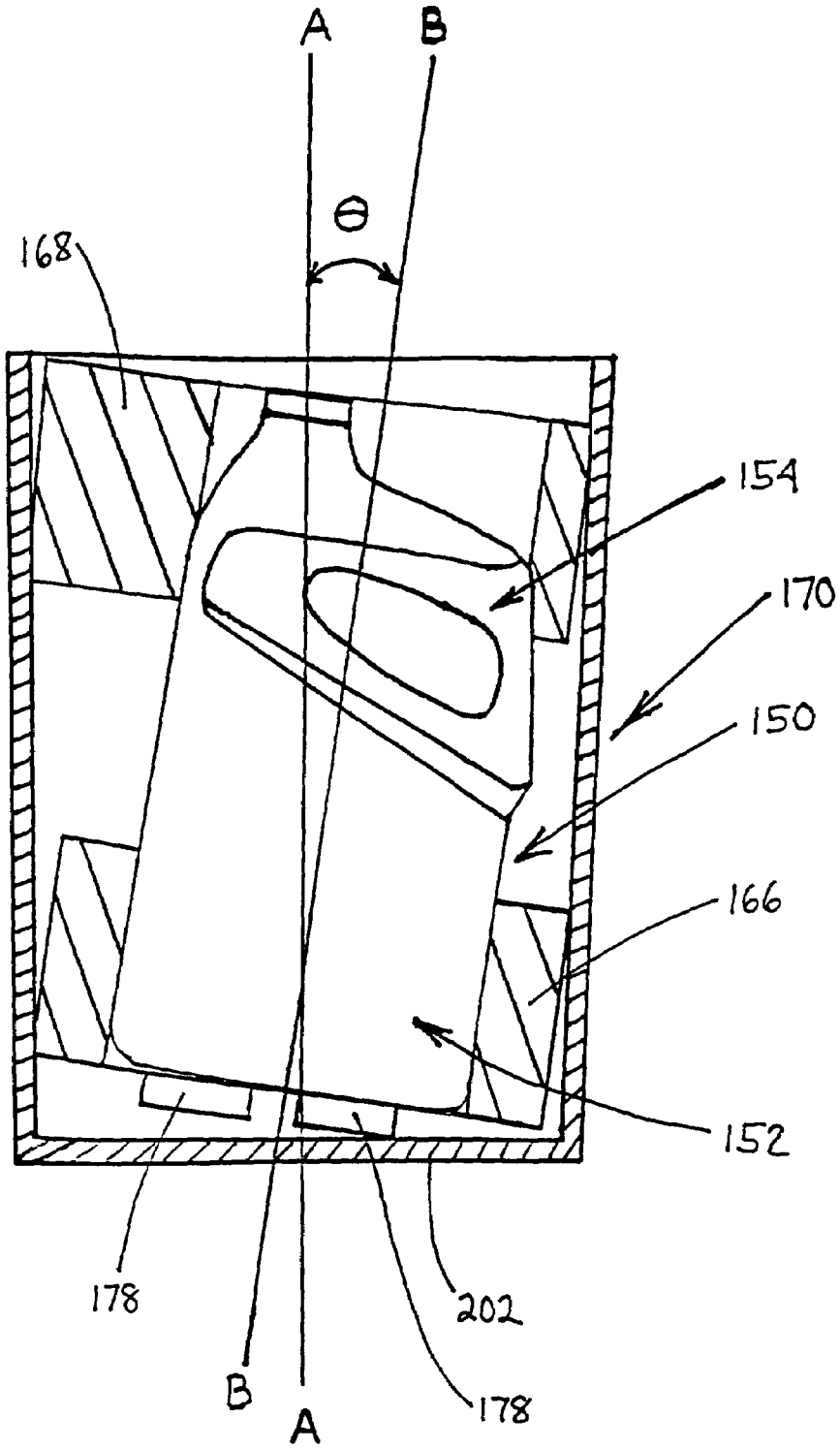
FIG. 16 shows a side sectional view of the F-style container being held in a five gallon bucket by the base and top inserts.

Referring now to FIGS. 10–13 there are shown a base insert 166 and a top insert 168 that cooperate to securely hold the container 150 in a conventional five gallon paint bucket, such as the bucket 170 (shown in FIGS. 2 and 16). Both the base insert 166 and the top insert 168 are composed of a foamed plastic, such as polyethylene foam.

The base insert 166 is generally cylindrical and has a diameter slightly greater than the interior diameter of the bucket 170 at the bottom thereof, which is about 10⅛ inches. An enlarged generally rectangular recess 172 is formed in the center of the base insert 166. The recess 172 is sized to snugly accommodate the bottom of the main portion 152 of the container 150 and is defined by a plurality of interior side surfaces 174 and one or more bottom surfaces 176. In the embodiment shown in FIGS. 10 and 11, there are a pair of bottom surfaces 176 that are part of pivotable flaps 178. The flaps 178 are integrally joined to the remainder of the base insert 166 at hinge portions 180. The height of the bottom surface(s) 176 above a lowermost point of the base insert 166 (which in the present embodiment is the bottom surfaces of the flaps 178) is selected such that when the container 150 is inserted in the base insert 166 and the base insert is inserted in the bucket 170, the center of gravity of the container 150 is below the center of gravity of the bucket 170.

Figure 11:
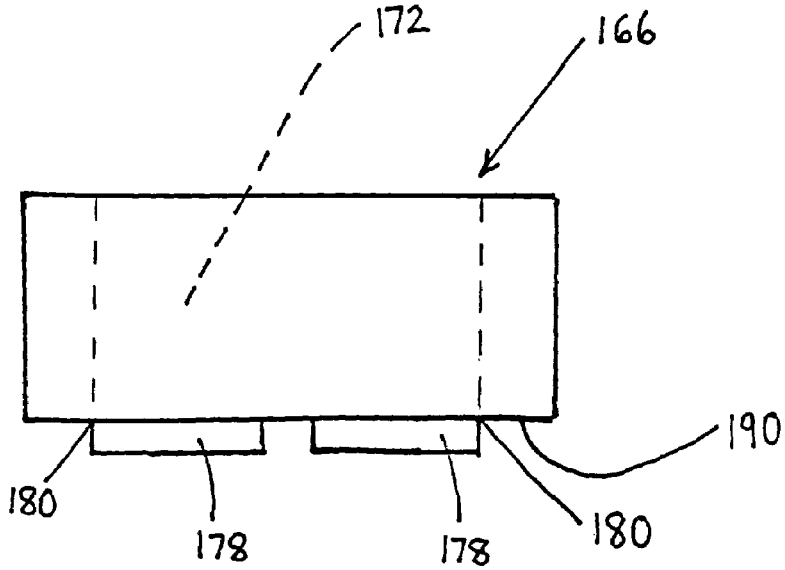
FIG. 11 shows a side view of the base insert.
Figure 12:
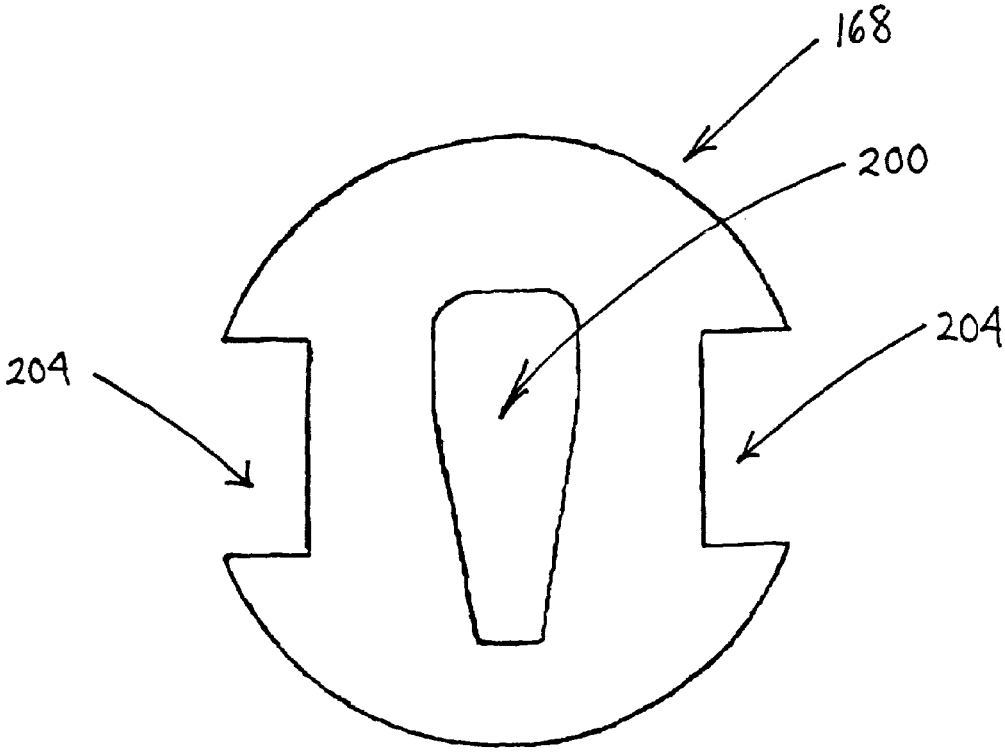
FIG. 12 shows a top view of a top insert of the present invention.
Figure 13:
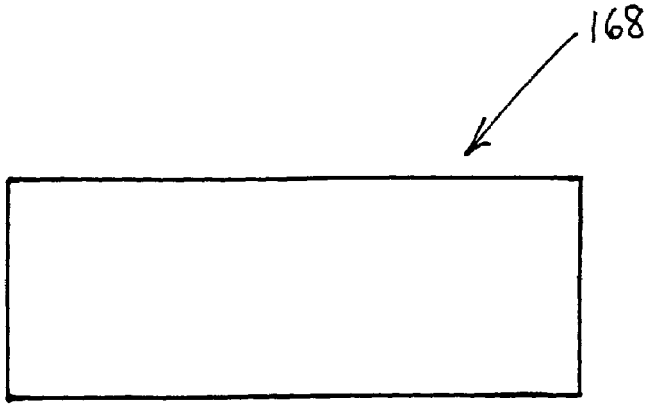
FIG. 13 shows a side view of the top insert.
Figure 14:
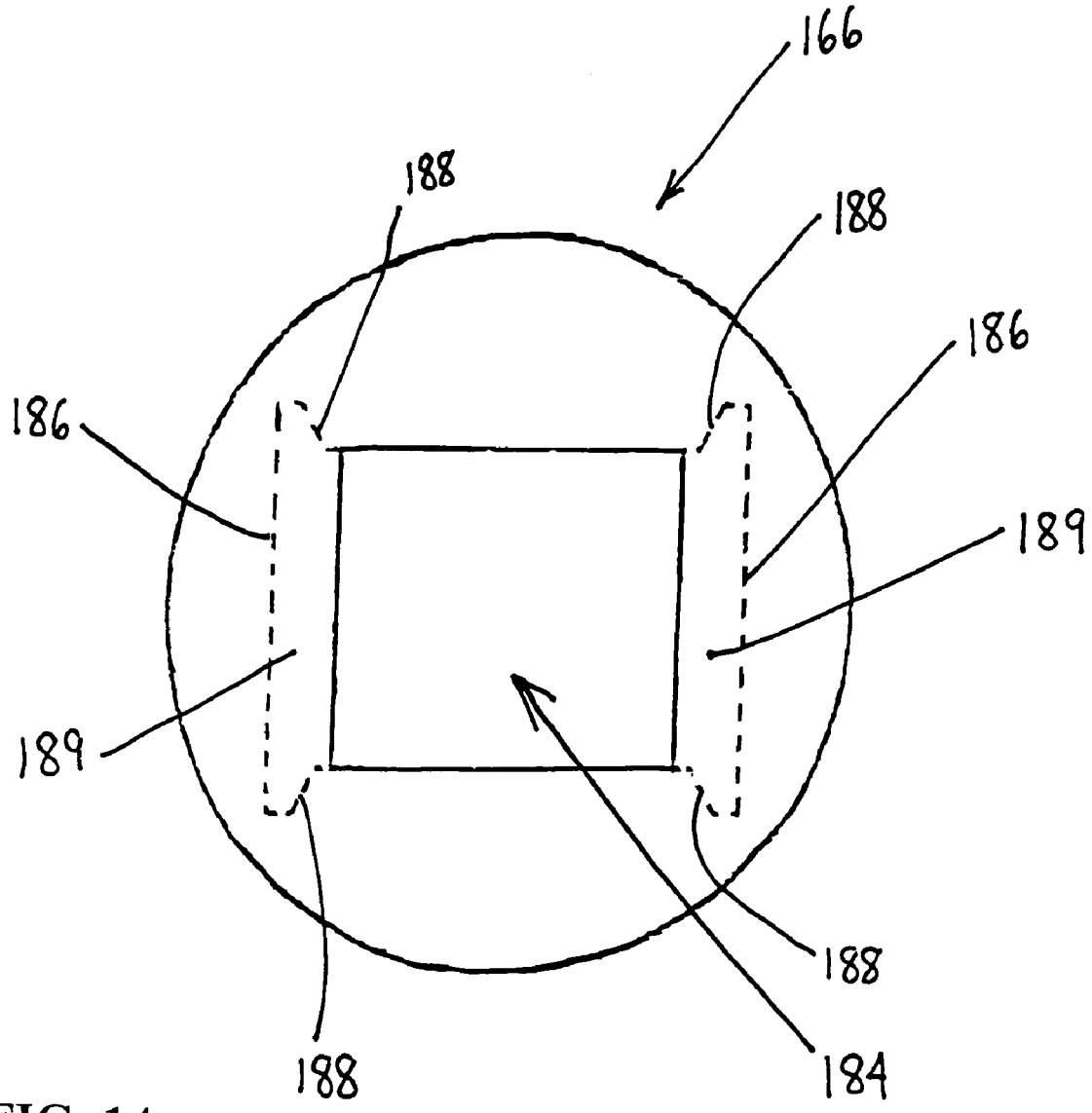
FIG. 14 shows a top view of the base insert with flaps being formed therein.
Figure 15:
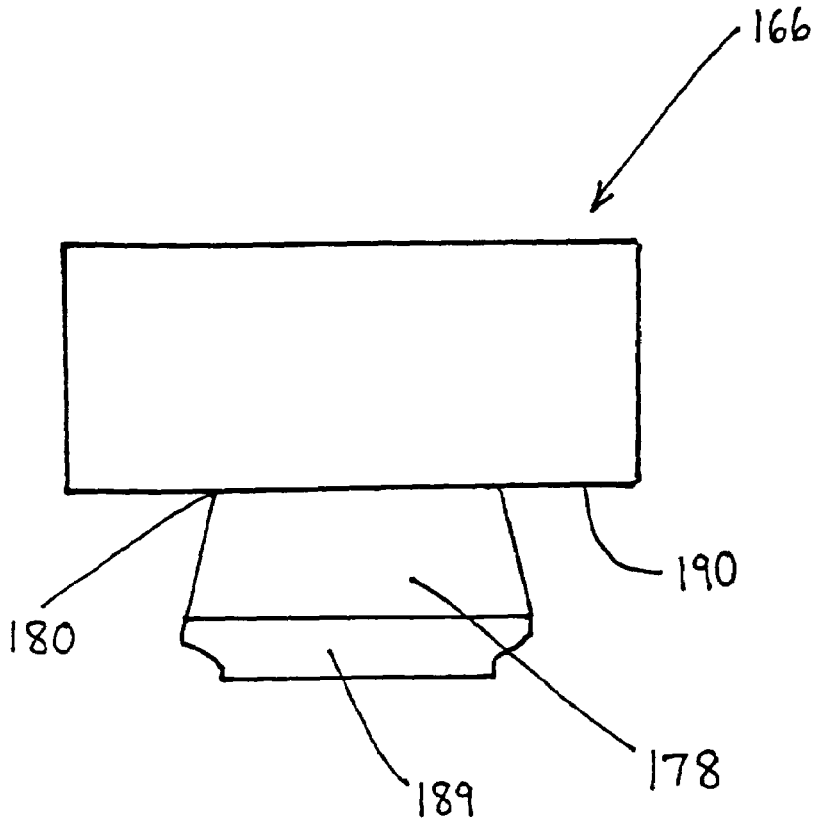
FIG. 15 shows a side view of the base insert with one of the flaps being pivoted downwardly.

The flaps 178 are formed during the manufacture of the base insert 166. More specifically, and with reference now to FIGS. 14 and 15, the base insert 166 is cut out of a single blank of polyethylene foam. A generally rectangular piece of the foam is cut out from the center of the base insert 166 to form a central opening 184. A pair of major cuts 186 (shown in dashed lines) and a plurality of minor cuts 188 (shown in dashed lines) are then made in the base insert 166 at opposing ends of the central opening 184. The major and minor cuts 186, 188 define the flaps 178, which have end surfaces 189. The minor cuts 188 extend completely through the base insert 166. The major cuts 186, however, do not fully extend through the base insert 166. Instead, the major cuts 186 stop short of a bottom surface 190 of the base insert 166, leaving the hinge portions 180 extending therebetween. Once the major and minor cuts 186, 188 are made in the base insert 166, the flaps 178 are pivoted downwardly (as shown in FIG. 15) such that the flaps 178 are disposed below the bottom surface 190 of the base insert (as shown in FIG. 11), with the major planar surfaces of the flaps 178 formed by the major cuts 186 becoming the bottom surfaces 176. The use of the flaps 178 to form the bottom surfaces 176 permits the recess 172 to be formed from the single blank of polyurethane foam without having to bore out foam.

The top insert 168 is generally cylindrical and has a diameter slightly greater than the interior diameter of the bucket 170 at the top thereof, which is about 11⅛ inches. A generally wedge-shaped recess 200 is formed in the center of the top insert 168. In the embodiment shown in FIG. 12, the recess 200 extends all the way through the top insert 168 so as take the form of an opening. The recess 200 is sized to snugly accommodate the handle portion 154 of the container 150. The recess 200 is offset slightly from the recess 172 in the base insert 166 when the top insert 168 and the base insert 166 are disposed in the bucket 170, parallel to a bottom wall 202 of the bucket 170. As will be discussed more fully below, this offset causes the container 150 to be tilted inside the bucket 170 (as shown in FIG. 16). A pair of enlarged notches 204 are cut out of opposing portions of the outer circumference of the top insert 168. The notches 204 are used as handles to pull the top insert out of the bucket 170.

It should be appreciated that in other embodiments of the present invention, the recess 200 in the top insert 168 can have different configurations to accommodate different shapes of handles in different types of F-style containers. For example, if a handle portion of an F-style container has a rectangular shape rather than a wedge shape, such as in the container 150, the recess 200 can be provided with a rectangular shape to snugly accommodate the rectangular handle portion.

The container 150 is secured inside the bucket 170, by first disposing the base insert 166 inside the bucket 170 such that the flaps 178 contact the bottom wall 202 of the bucket 170 and the recess 172 extends upwardly. The container 150 is then disposed in the bucket 170 such that the bottom of the main portion 152 of the container 150 is securely held in the recess 172. In order to align the handle portion 154 of the container 150 with the opening in the top insert 168, the container 150 and the base insert 166 are tipped. The top insert 168 is then inserted into the bucket 170 such that the handle portion 154 extends into the recess 200. The top insert 168 is preferably tipped to more fully insert the handle 160 in the opening.

Referring now to FIG. 16, the base insert 166 and the top insert 168 are shown cooperating to securely hold the container 150 in the bucket 170. The main portion 152 is held by the base insert 166, while the handle portion 154 is held by the top insert 168. The container 150 and the base and top inserts 166, 168 are shown tipped at an angle relative to the bucket 170. More specifically, an axis B—B of the container 150 is disposed at angle θ to an axis A—A of the bucket 170. Preferably the angle θ is from about 3 to about 15 degrees. The positioning of the container 150 at angle relative to the bucket 170 improves the mixing of the tinting concentrate in the container 150. The center of gravity of the container 150 is disposed below the center of gravity of the bucket 170.

Although not shown, a lid may be secured over the opening of the bucket 170. In some mixing machines, the lid must be secured over the opening of the bucket 170 to prevent damaging the bucket 170.

Referring back to FIG. 2, the bucket 170 with the container 150 secured therein is disposed on the table 70 of the mixing apparatus 10. The clamp assembly 76 is moved downward into contact with the bucket 170 and presses the bucket 170 into the pads 74, 82. The clamp assembly 76 continues to apply force to the bucket 170 until a predetermined maximum amount of force is reached, at which point the control system 106 controls the clamping motor 100 to maintain a clamping pressure on the bucket 170 that does not exceed the maximum amount of force. With the bucket 170 so positioned between the clamp assembly 76 and the table 70, the bucket 170 and, thus the container 150, are secured from movement relative to the clamp assembly 76 and the table 70. The shaking motor 34 may then be energized, which causes the inner frame 22 to vibrate. The vibration of the inner frame 22 is imparted to the bucket 170 and, thus, the container 150, thereby mixing the tinting concentrate disposed therein.

The applicant has found that when a tinting concentrate is mixed in accordance with the present invention in a mixing machine, such as the mixing apparatus 10, the pigment in the tinting concentrate remains in suspension for up to 30 days. The method taught herein is useful for mixing any fluid material which can be conveniently contained in rectangular containers such as F-style containers. Other fluid materials would include paints, stains, waterproofing sealants, blends of solvents, detergents, insecticides, sanitation chemicals, etc.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A method of mixing a fluid material comprised within an F-style container, said method comprising the steps of:

(a.) providing a mixing apparatus comprising:
a table;
a clamp assembly movably disposed above the table;
an electric motor connected to the table for vibrating the table;

(b.) providing an F-style container with the fluid material disposed therein;

(c.) providing a bucket with an interior sized to receive the F-style container therein;

(d.) providing a base insert with a bottom recess formed therein, said base insert being sized to be snugly received in the bucket and said bottom recess being sized to snugly receive a bottom portion of the F-style container therein;

(e.) providing a top insert with a top recess formed therein, said top insert being sized to be snugly received in the bucket and said top recess being sized to snugly receive a top portion of the F-style container therein;

(f.) inserting the base insert in the bucket;

(g.) inserting the bottom portion of the F-style container in the bottom recess of the base insert;

(h.) inserting the F-style container in the bucket;

(i.) inserting the top portion of the F-style container in the top recess of the top insert;

(j.) inserting the top insert in the bucket;

(k.) placing the bucket with the base insert, the top insert and the F-style container disposed therein onto the table of the mixing apparatus;

(l.) moving the clamp assembly to clamp the bucket to the table; and (m.) energizing the electric motor to vibrate the table, thereby mixing the fluid material.

2. The method of claim 1 wherein the fluid material is a tinting concentrate.

3. The method of claim 1 wherein the base inert is inserted into the bucket before the bottom portion of the F-style container is disposed in the bottom recess of the base insert, and wherein the F-style container is inserted into the bucket when the bottom portion of the F-style container is disposed in the bottom recess of the base insert.

4. The method of claim 3 wherein top insert is inserted into the bucket when the top portion of the F-style container is inserted into the top recess of the top insert.

5. The method of claim 1 wherein the base insert and the top insert are composed of plastic foam.

6. The method of claim 1 wherein the container when snugly received into the base insert and top insert is tilted at an angle relative to the interior of the bucket.

7. The method of claim 6 wherein the angle is between about 3° and about 15°.

* * * * *